US008596761B2

(12) United States Patent
Kobayashi et al.

(10) Patent No.: US 8,596,761 B2
(45) Date of Patent: Dec. 3, 2013

(54) LIQUID EJECTING HEAD, LIQUID EJECTING APPARATUS, AND METHOD OF MANUFACTURING LIQUID EJECTING HEAD

(75) Inventors: Hiroyuki Kobayashi, Azumino (JP); Hiroshige Owaki, Okaya (JP); Shigeki Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/413,622

(22) Filed: Mar. 6, 2012

(65) Prior Publication Data

US 2012/0229570 A1 Sep. 13, 2012

(30) Foreign Application Priority Data

Mar. 7, 2011 (JP) ..... 2011-049540

(51) Int. Cl.
*B41J 2/14* (2006.01)

(52) U.S. Cl.
USPC ..... 347/47

(58) Field of Classification Search
USPC ..... 347/40, 43, 47
See application file for complete search history.

(56) References Cited

U.S. PATENT DOCUMENTS 7,862,151 B2 * 1/2011 McAvoy et al. ..... 347/47
8,091,984 B2 * 1/2012 Silverbrook ..... 347/47

FOREIGN PATENT DOCUMENTS

JP 2003-011383 A 1/2003

* cited by examiner

*Primary Examiner* — Lamson Nguyen
(74) *Attorney, Agent, or Firm* — Kilpatrick Townsend & Stockton LLP

(57) ABSTRACT

A liquid ejecting head includes head main bodies each having a nozzle plate having nozzle openings, and a case member to which the head main bodies are fixed, and moves relatively in a first direction with respect to a recording sheet, wherein a cover head which covers the side surfaces of the head main body and a peripheral border of the nozzle plate is provided at each head main body, a protective wall is provided for each head main body between an end portion in the first direction of the case member and the head main body, a range in a second direction of the cover head is included in a range in the second direction of the protective wall, and the protective wall is located further on the case member side than the nozzle plate in a third direction.

7 Claims, 11 Drawing Sheets

LIQUID EJECTING HEAD, LIQUID EJECTING APPARATUS, AND METHOD OF MANUFACTURING LIQUID EJECTING HEAD

BACKGROUND

1. Technical Field

The present invention relates to a liquid ejecting head which ejects liquid supplied from a liquid storage section to a head main body through a liquid supply path, from a nozzle, a liquid ejecting apparatus, and a method of manufacturing a liquid ejecting head.

2. Related Art

An ink jet type recording head that is a representative example of a liquid ejecting head is generally configured such that ink is supplied from an ink cartridge (a liquid storage section) filled with ink to a pressure generation chamber of a head main body through an ink flow path (a liquid flow path). Then, by imparting pressure to the inside of the pressure generation chamber by a pressure generation section such as a piezoelectric element, an ink droplet is ejected from a nozzle which communicates with the pressure generation chamber.

As the specific configuration of the ink jet type recording head, for example, there is a recording head which is provided with a plurality of head main bodies and a case member to which the head main bodies are fixed, and in which a circuit substrate that supplies a signal for driving a piezoelectric element is fixed to the inside of the case member (refer to JP-A-2003-11383, for example).

Such a head main body has a nozzle plate in which nozzles are provided, and a cover head (a covering member) which covers a peripheral border of the nozzle plate and the side surfaces of the head main body is provided. By providing the cover head at the head main body, even if a recording medium such as recording paper collides with the head main body at the time of printing, since the recording medium collides with the cover head, the nozzle plate is protected. In this way, damage of the nozzle plate or detachment of the nozzle plate from the head main body is prevented.

On the other hand, the circuit substrate and the piezoelectric element of the head main body are connected to each other by a drive wiring. The drive wiring is, for example, a flexible wiring member (a COF substrate) or the like. One end of the drive wiring is connected to the piezoelectric element of the head main body and the other end side is connected to a given terminal of the circuit substrate by solder or the like.

In the connection of such a drive wiring to the circuit substrate, the case member is held by a jig, and the head main body in which one end of the drive wiring is connected to the piezoelectric element is disposed at a given position of the case member. A state is maintained where the circuit substrate is accommodated in the case member and the other end (a joining portion) of the drive wiring is folded to the terminal side of the circuit substrate. Then, by heating the solder, the other end of the drive wiring is joined to the terminal of the circuit substrate.

However, although the head main body is protected by the cover head, the cover head itself is not protected from collision of the recording medium. For this reason, there is concern that the cover head itself may be worn or the cover head may drop out of the head main body due to entry of the recording medium into the clearance between the head main body and the cover head, or the like.

Further, at the time of the connection of the drive wiring to the circuit substrate, a given load is applied to the joining portion of the drive wiring folded to the terminal side of the circuit substrate, thereby bringing the joining portion of the drive wiring into close contact with the terminal of the circuit substrate. For this reason, a load is also applied to the circuit substrate and furthermore, the load is also applied to the case member retained in the jig. At this time, since end portions of the case member are held on the jig, if a load is applied to the central portion, there is concern that the case member may be bent. A flexure also arises in the circuit substrate due to the flexure of the case member, so that a clearance is formed between the circuit substrate and the joining portion of the drive wiring, whereby poor joining can arise.

In addition, such a problem is similarly present not only in the ink jet type recording head, but also in a liquid ejecting head which ejects liquid other than ink.

SUMMARY

An advantage of some aspects of the invention is that it provides a liquid ejecting head in which it is possible to protect a covering member provided at a head main body and reliably join a drive wiring to a circuit substrate, a liquid ejecting apparatus, and a method of manufacturing a liquid ejecting head.

According to an aspect of the invention, there is provided a liquid ejecting head including head main bodies each having a liquid ejecting surface in which nozzle openings that eject liquid are provided, and a case member to which the head main bodies are fixed, and relatively moving in a first direction with respect to a recording medium onto which a liquid droplet is ejected, wherein a covering member which covers a peripheral border of the liquid ejecting surface and side surfaces continued from the liquid ejecting surface is provided at each head main body, and at the case member, a protective member which protects the covering member is provided for each head main body between an end portion in the first direction of the case member and the head main body, a range in a second direction perpendicular to the first direction of the covering member is included in a range in the second direction of the protective member, and the protective member is located further on the case member side than the liquid ejecting surface in a third direction perpendicular to the first direction and the second direction.

In such an aspect, the protective member is interposed between the recording medium which moves relatively with respect to the liquid ejecting head along the first direction and the covering member, thereby protecting the entire side surface in the second direction of the covering member from the recording medium. By configuring the protective member in this manner, collision of the recording medium with the covering member is prevented, so that wear of the covering member can be prevented.

Here, it is preferable that the protective member be located further on the liquid ejecting surface side than an end portion on the case member side of the covering member which covers the side surfaces of the head main body. According to this, entry of the recording medium into the clearance between the head main body and the covering member is prevented. As a result, dropout of the covering member from the head main body due to entry of the recording medium into the clearance is prevented.

Further, it is preferable that in the protective member, the length in the second direction be longer than the length in the first direction. According to this, the stiffness in the second direction of the case member is improved, so that flexure of the case member is prevented. As a result, flexure of the circuit substrate with the flexure of the case member and detachment of the drive wiring from the circuit substrate are prevented.

Further, according to another aspect of the invention, there is provided a liquid ejecting apparatus including the liquid ejecting head according to the above aspect.

In such an aspect, a liquid ejecting head in which the covering member provided at the head main body is protected and the drive wiring is reliably joined to the circuit substrate is realized.

Further, according to still another aspect of the invention, there is provided a method of manufacturing a liquid ejecting head which includes: head main bodies each having a liquid ejecting surface in which nozzle openings that eject liquid are provided; a case member to which the head main bodies are fixed; a covering member which covers a peripheral border of the liquid ejecting surface of each head main body and side surfaces continued from the liquid ejecting surface; a protective member which is provided for each head main body between an end portion in a first direction of the case member and the head main body, thereby protecting the covering member; and a circuit substrate which is provided in the case member and to which a pressure generation element constituting the head main body is connected through a drive wiring, and moves relatively in the first direction with respect to a recording medium onto which a liquid droplet is ejected, the method including: bringing the protective members into contact with a jig, thereby retaining the case member in the jig; and connecting the other end of the drive wiring, one end of which is connected to the pressure generation element of the head main body, to the circuit substrate.

In such an aspect, a liquid ejecting head in which the covering member provided at the head main body is protected and the drive wiring is reliably joined to the circuit substrate is realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

An embodiment of the invention will be described in detail. Hereinafter, an ink jet type recording head is one example of a liquid ejecting head and will also be simply referred to as a recording head.

Figure 1:
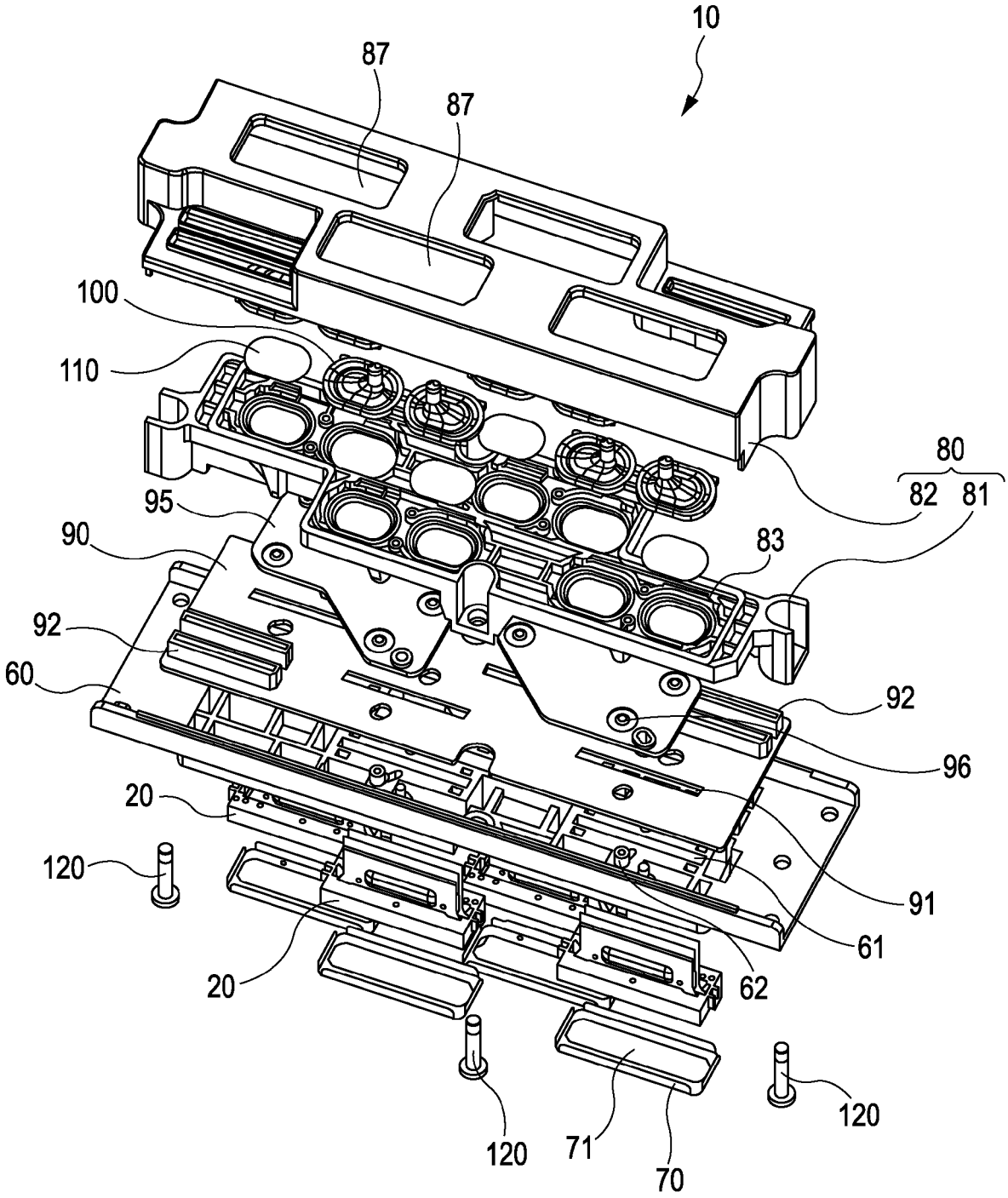
FIG. 1 is an exploded perspective view of a recording head related to Embodiment 1 when viewed from one face side.
Figure 2:
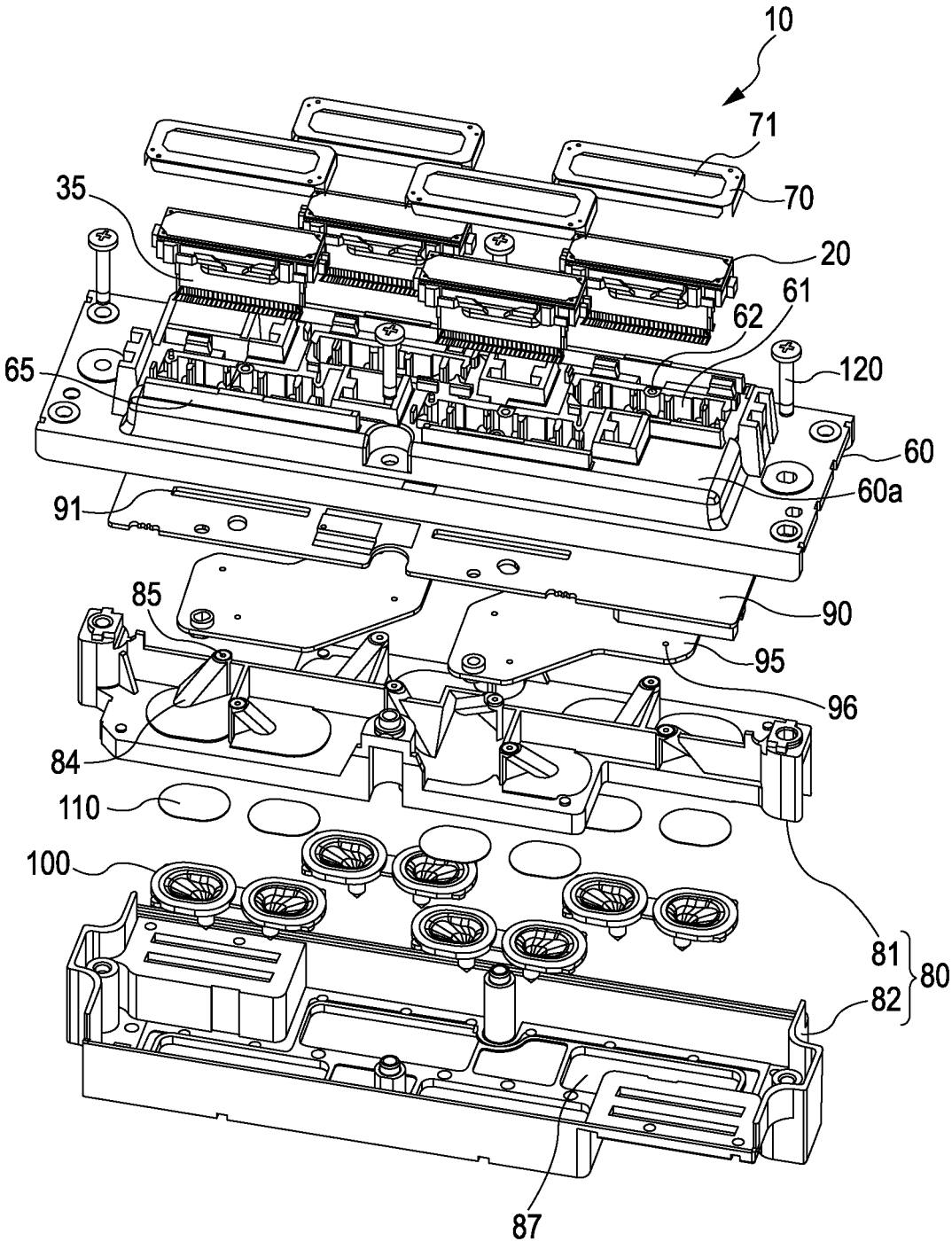
FIG. 2 is an exploded perspective view of the recording head related to Embodiment 1 when viewed from the other face side.
Figure 3:
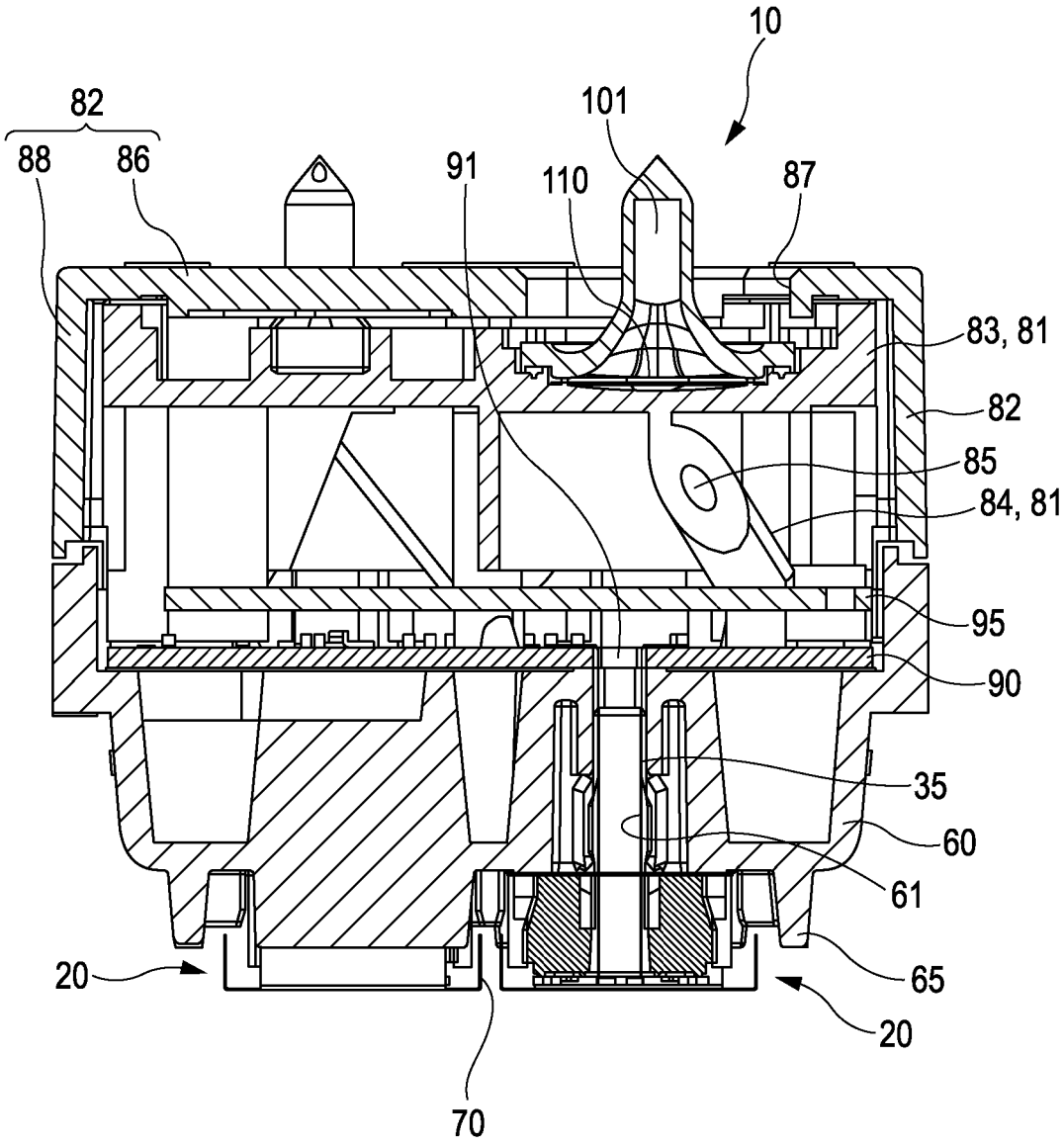
FIG. 3 is a cross-sectional view of the recording head related to Embodiment 1.

FIG. 1 is an exploded perspective view of the recording head related to this embodiment when viewed from one face side (the opposite side to a nozzle), FIG. 2 is an exploded perspective view of the recording head related to this embodiment when viewed from the other face side (the nozzle side), and FIG. 3 is a cross-sectional view of the recording head related to this embodiment.

As shown in FIGS. 1 and 2, a recording head 10 includes a plurality of head main bodies 20 which eject ink droplets, a case member 60 to which the head main bodies 20 are fixed, a flow path member 80 provided on the opposite surface side to the head main bodies 20 of the case member 60, and a circuit substrate 90 which is provided between the case member 60 and the flow path member 80.

Figure 4:
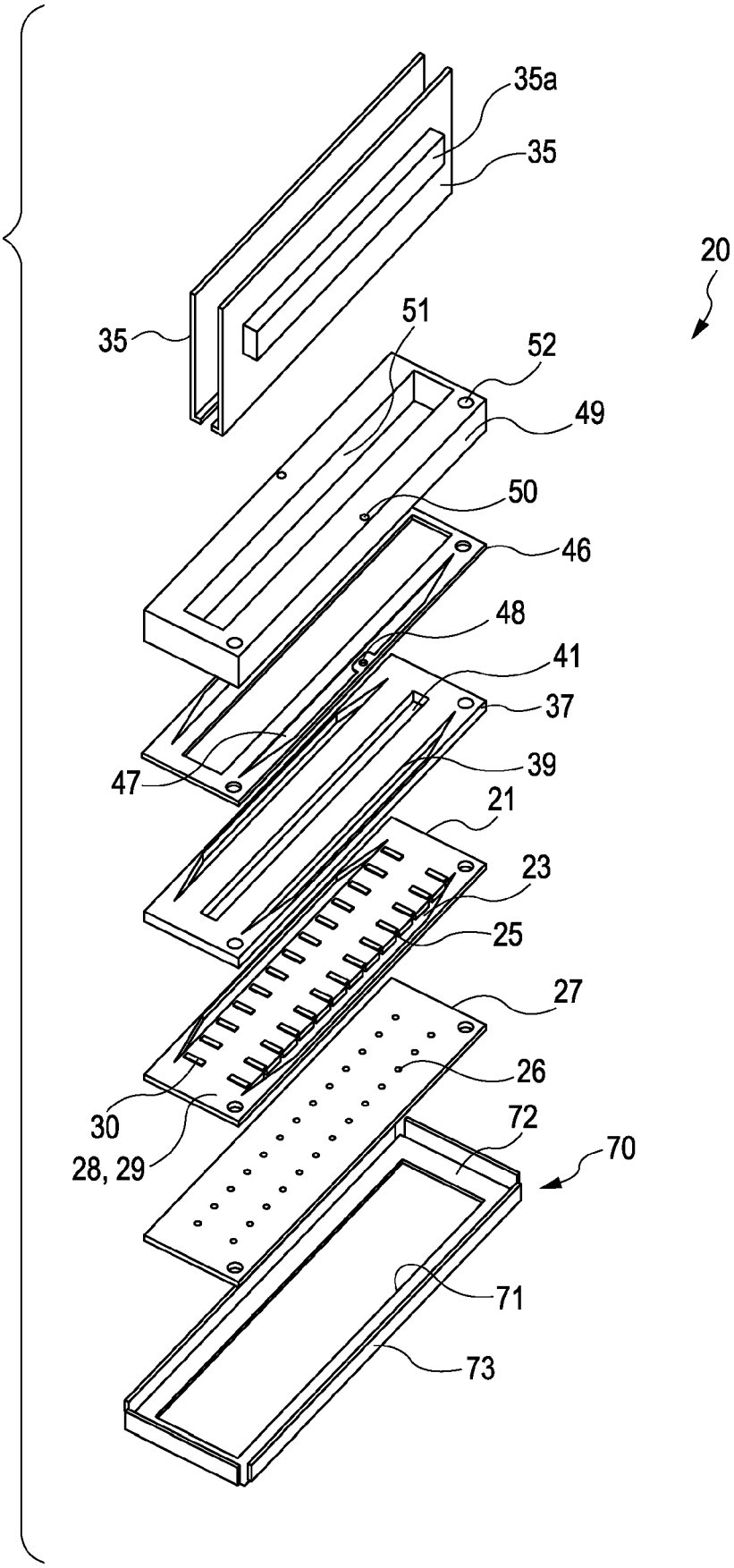
FIG. 4 is an exploded perspective view of a head main body related to Embodiment 1.
Figure 5:
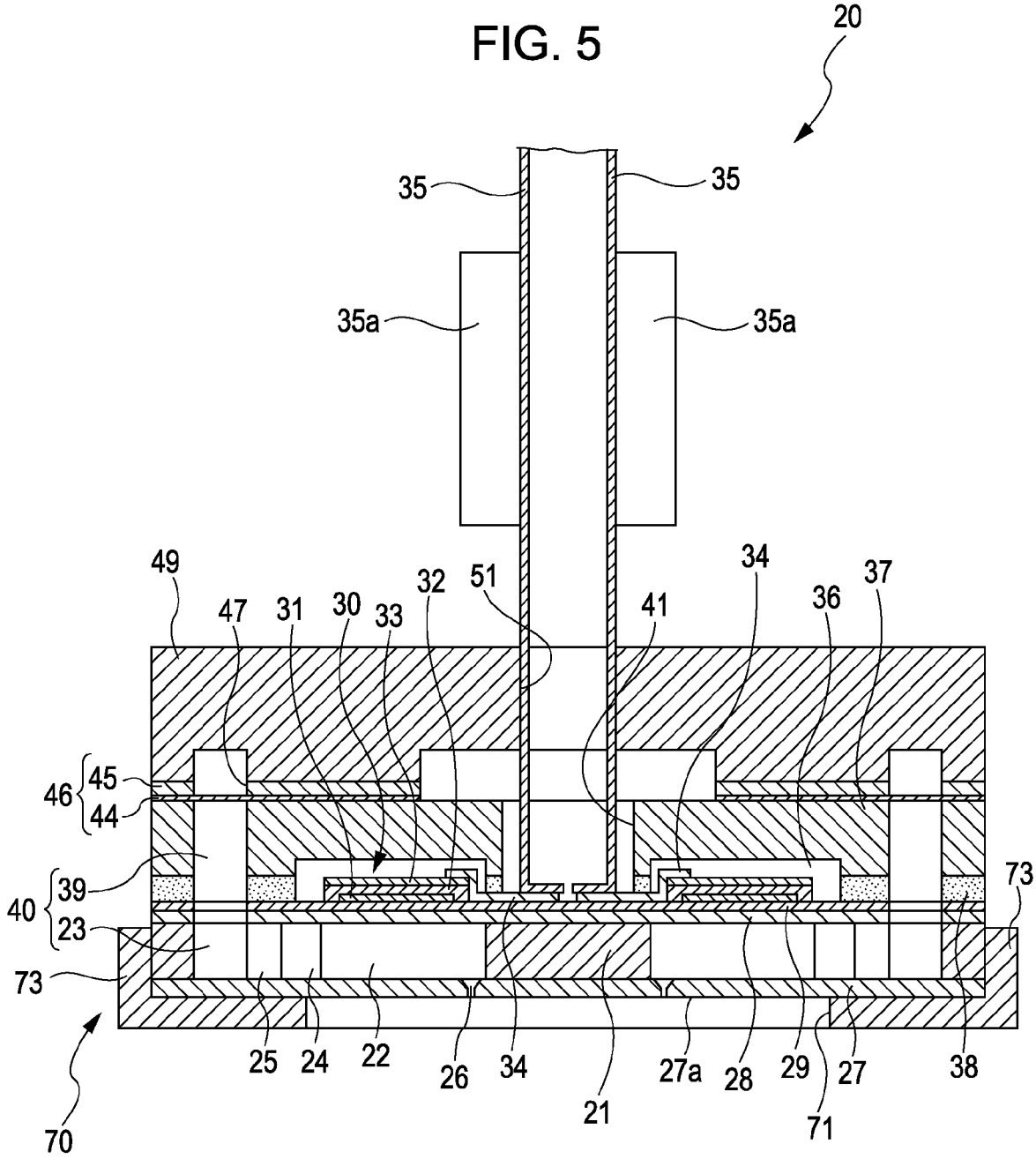
FIG. 5 is a cross-sectional view of the head main body related to Embodiment 1.

One example of the configuration of the head main body 20 will be described with reference to FIGS. 4 and 5. FIG. 4 is an exploded perspective view of the head main body related to this embodiment, and FIG. 5 is a cross-sectional view in a longitudinal direction of a pressure generation chamber of the head main body. The longitudinal direction of the pressure generation chamber, as referred to herein, is a direction (a horizontal direction in FIG. 5) intersecting a direction (a direction perpendicular to the plane of paper of FIG. 5) in which nozzle openings 26 are arranged side by side.

As shown in these drawings, in a flow path formation substrate 21 constituting the head main body 20, a row in which a plurality of pressure generation chambers 22 are arranged side by side in the width direction thereof is provided in two rows. Further, a communication portion 23 is formed in an area outside the longitudinal direction of each row of the pressure generation chambers 22, and the communication portion 23 and each pressure generation chamber 22 communicate with each other through an ink supply path 24 and a communication path 25 which are provided for each pressure generation chamber 22.

A nozzle plate 27, in which the nozzle openings 26 communicating with the vicinity of an end portion on the opposite side to the ink supply path 24 of each pressure generation chamber 22 are perforated, is joined to the surface on one side of the flow path formation substrate 21.

On the other hand, on the surface on the opposite side to the nozzle plate 27 of the flow path formation substrate 21, piezoelectric elements 30 are formed with an elastic film 28 and an insulator film 29 interposed therebetween. Each piezoelectric element 30 is constituted by a first electrode 31, a piezoelectric body layer 32, and a second electrode 33. A lead electrode 34 provided to extend onto the insulator film 29 is connected to the second electrode 33 constituting each piezoelectric element 30. One end portion of the lead electrode 34 is connected to the second electrode 33 and the other end portion side is connected to a drive wiring 35. The drive wiring 35 is a flexible wiring member (a COF substrate) and a driving IC 35*a* for driving the piezoelectric elements 30 is mounted on the drive wiring 35. In this manner, the lead electrode 34 is connected to one end side of the drive wiring 35, and the other end side of the drive wiring 35 is fixed to the circuit substrate 90 (refer to FIG. 3).

On the flow path formation substrate 21 in which the piezoelectric elements 30 are formed, a protective substrate 37 having a piezoelectric element retention portion 36 which is a space for protecting the piezoelectric elements 30 is joined to an area facing the piezoelectric elements 30 by an adhesive 38. Further, in the protective substrate 37, a manifold portion 39 is provided. In this embodiment, the manifold portion 39 communicates with the communication portion 23 of the flow path formation substrate 21, thereby constituting a manifold 40 which becomes an ink chamber common to the respective pressure generation chambers 22.

Further, in the protective substrate 37, a through-hole 41 which penetrates the protective substrate 37 in the thickness direction is provided. In this embodiment, the through-hole 41 is provided between two piezoelectric element retention portions 36. Then, the vicinity of an end portion of the lead electrode 34 led out from each piezoelectric element 30 is provided so as to be exposed in the through-hole 41.

Further, a compliance substrate 46 composed of a sealing film 44 and a fixed plate 45 is joined onto the protective substrate 37. Here, the sealing film 44 is made of a material which is low in stiffness and has flexibility, and the face on one side of the manifold portion 39 is sealed by the sealing film 44. Further, the fixed plate 45 is formed of a hard material such as metal. Since the area of the fixed plate 45 which faces the manifold 40 turns into an opening portion 47 completely removed in the thickness direction, the face on one side of the manifold 40 is sealed only by the sealing film 44 having flexibility. Further, in the compliance substrate 46, an ink introduction port 48 for introducing ink into the manifold 40 is provided.

A head case 49 is fixed onto the compliance substrate 46. In the head case 49, an ink introduction path 50 which communicates with the ink introduction port 48, thereby supplying ink from a storage section such as a cartridge to the manifold 40, is provided. Further, in the head case 49, a through-hole 51 which communicates with the through-hole 41 provided in the protective substrate 37 is provided, and in a state where the drive wiring 35 is inserted into the through-hole 51, the one end side of the drive wiring 35 is connected to the lead electrode 34.

In the respective members constituting the head main body 20, positioning holes 52, into which pins for positioning each member at the time of assembly are inserted, are provided at two places that are corner portions on both sides in a longitudinal direction. Then, by joining the respective members to each other while performing relative positioning of the respective members by inserting the pins into the positioning holes 52, the head main body 20 is formed in an integrated fashion.

Further, to the liquid ejecting surface 27*a* side in which the nozzle openings 26 of the nozzle plate 27 of the head main body 20 are opened, a cover head 70 that is a covering member is fixed.

The cover head 70 is a member that covers a peripheral border of the surface of the nozzle plate 27 (the liquid ejecting surface 27*a* of the recording head 10) and the side surfaces intersecting the liquid ejecting surface 27*a*. Although a material of the cover head 70 is not particularly limited, the cover head 70 is formed of metal, for example.

The cover head 70 has a box shape in which edge portions of a rectangular plate-like member are bent to the side surface side of the head main body 20, and the bottom surface thereof is joined to the liquid ejecting surface 27*a* by an adhesive (not shown). Specifically, the cover head 70 has an exposed opening portion 71 which is opened into a rectangular shape and exposes the nozzle openings 26, and a rectangular frame portion 72 which defines the exposed opening portion 71 and is provided along a peripheral border portion of the liquid ejecting surface 27*a*. Further, at the cover head 70, a side wall portion 73 provided so as to be bent to the side surface side perpendicular to the liquid ejecting surface 27*a* of the head main body 20 is provided. The side wall portion 73 covers the four side surfaces of head main body 20.

The frame portion 72 has a size in which the outer periphery thereof is larger than the outer periphery of the nozzle plate 27 that is the liquid ejecting surface 27*a* and the inner periphery, that is, the exposed opening portion 71 defined by the frame portion 72 is smaller than the outer periphery of the nozzle plate 27. In this way, the frame portion 72 is disposed facing the outer peripheral portion of the nozzle plate 27 and then bonded to the peripheral border portion of the nozzle plate 27 through an adhesive.

Each head main body 20 having such a configuration is fixed to the case member 60. As shown in FIGS. 1 to 3, a plurality of (in this embodiment, four) head main bodies 20 are fixed to the bottom surface 60*a* side of the case member 60.

In the case member 60, a through-hole 61 which penetrates the case member 60 in the thickness direction is provided corresponding to each head main body 20. A supply path 62 which communicates with the ink introduction path 50 provided in the head case 49 of the head main body 20 is provided outside each through-hole 61 of the case member 60. Then, in a state where the drive wiring 35 of each head main body 20 is inserted into the through-hole 61 and the ink introduction path 50 and the supply path 62 communicate with each other, the head case 49 of each head main body 20 is joined to a circumferential edge portion of the through-hole 61.

Further, in the case member 60, a protective wall 65 that is one example of a protective member which protects the cover head 70 provided at the head main body 20 from a recording medium such as paper is provided for each head main body 20. The details of the protective wall 65 will be described later.

The flow path member 80 is fixed to the surface on the opposite side to the head main bodies 20 of the case member 60 with the circuit substrate 90 and seal members 95 made of a rubber material or the like interposed therebetween.

On the circuit substrate 90, electronic components for driving the piezoelectric elements 30, as described above, or various wirings are mounted. Further, in the circuit substrate 90, connection holes 91 which penetrate the circuit substrate 90 in the thickness direction are provided. Then, the drive wirings 35 of the head main bodies 20 are inserted into the connection holes 91 and leading end portions thereof are electrically connected to various wirings or the like of the circuit substrate 90 by solder or the like.

The flow path member 80 includes a flow path member main body 81 and a cover member 82. The above-mentioned circuit substrate 90 and the seal members 95 are retained between the flow path member main body 81 constituting the flow path member 80 and the case member 60.

Further, the flow path member main body 81 is configured to include a fixed portion 83 in which a plurality of ink supply needles 100 that are inserted into ink cartridges are fixed to one surface side, and flow path formation portions 84 which are provided to protrude at the lower surface of the fixed portion 83. In each flow path formation portion 84, an ink supply hole 85 is formed, one end side of which is opened facing the ink supply needle 100. Then, the other end side of the ink supply hole 85 is connected to the supply path 62 of the case member 60 through a supply communication path 96 provided at the seal member 95.

In addition, a filter 110 for removing air bubbles or foreign matter in ink is provided in an opening portion on one end side of each ink supply hole 85. That is, each ink supply needle 100 is fixed to the fixed portion 83 of the flow path member main body 81 with the filter 110 interposed therebetween.

Each ink supply needle 100 has in the inside thereof a penetration path 101 which communicates with the ink supply hole 85. The penetration path 101 communicates with the ink supply hole 85 through the filter 110.

The cover member 82 has an approximate box shape, the lower surface side (the head main body 20 side) of which is opened, and is integrated with the flow path member main body 81 in a state where the cover member 82 is superimposed on the flow path member main body 81 from the ink supply needle 100 side. Specifically, the cover member 82 is provided with a bottom surface portion (an upper surface portion) 86 having opening portions 87 in which the ink supply needles 100 are exposed, and a wall surface portion 88 which is provided to surround the flow path formation portions 84 and has a height reaching the case member 60.

In a state where the cover member 82 is superimposed on the flow path member main body 81 from the ink supply needle 100 side and the circuit substrate 90 and the seal members 95 are sandwiched between the flow path member main body 81 and the case member 60, the cover member 82 and the case member 60 are fixed to each other by fastening members 120 such as screws, for example. In this way, the flow path member main body 81 and the cover member 82 are integrated with each other, whereby the flow path member 80 is formed and also the flow path member 80 and the case member 60 are integrated with each other. In this embodiment, the flow path member 80 and the case member 60 are fixed to each other by four fastening members 120 respectively provided at the respective sides thereof (refer to FIG. 1).

A space is formed by the cover member 82 and the case member 60 and the circuit substrate 90 is accommodated in the space. That is, the circuit substrate 90 with electronic components or the like for driving the piezoelectric elements 30 mounted thereon is covered by the flow path member 80 and the case member 60. In this way, ink mist which is generated when ejecting ink droplets from the nozzle openings 26 of the head main body 20, or the like, is prevented from being attached to the circuit substrate 90.

In the recording head 10 related to this embodiment, ink is supplied from the storage section (not shown) such as an ink cartridge to the ink supply needle 100 and a pathway passing the penetration path 101, the ink supply path 85, the supply path 62, and the like and then ranging from the manifold 40 of the head main body 20 to the nozzle opening 26 is filled with ink. Then, in the recording head 10, voltage is applied to each piezoelectric actuator 30 corresponding to the pressure generation chamber 22 in accordance with a recording signal from the driving IC 35*a*, so that the elastic film 28, the insulator film 29, and the piezoelectric actuator 30 are flexural-deformed, whereby pressure in each pressure generation chamber 22 is increased, so that an ink droplet is ejected from the nozzle opening 26.

Figure 6:
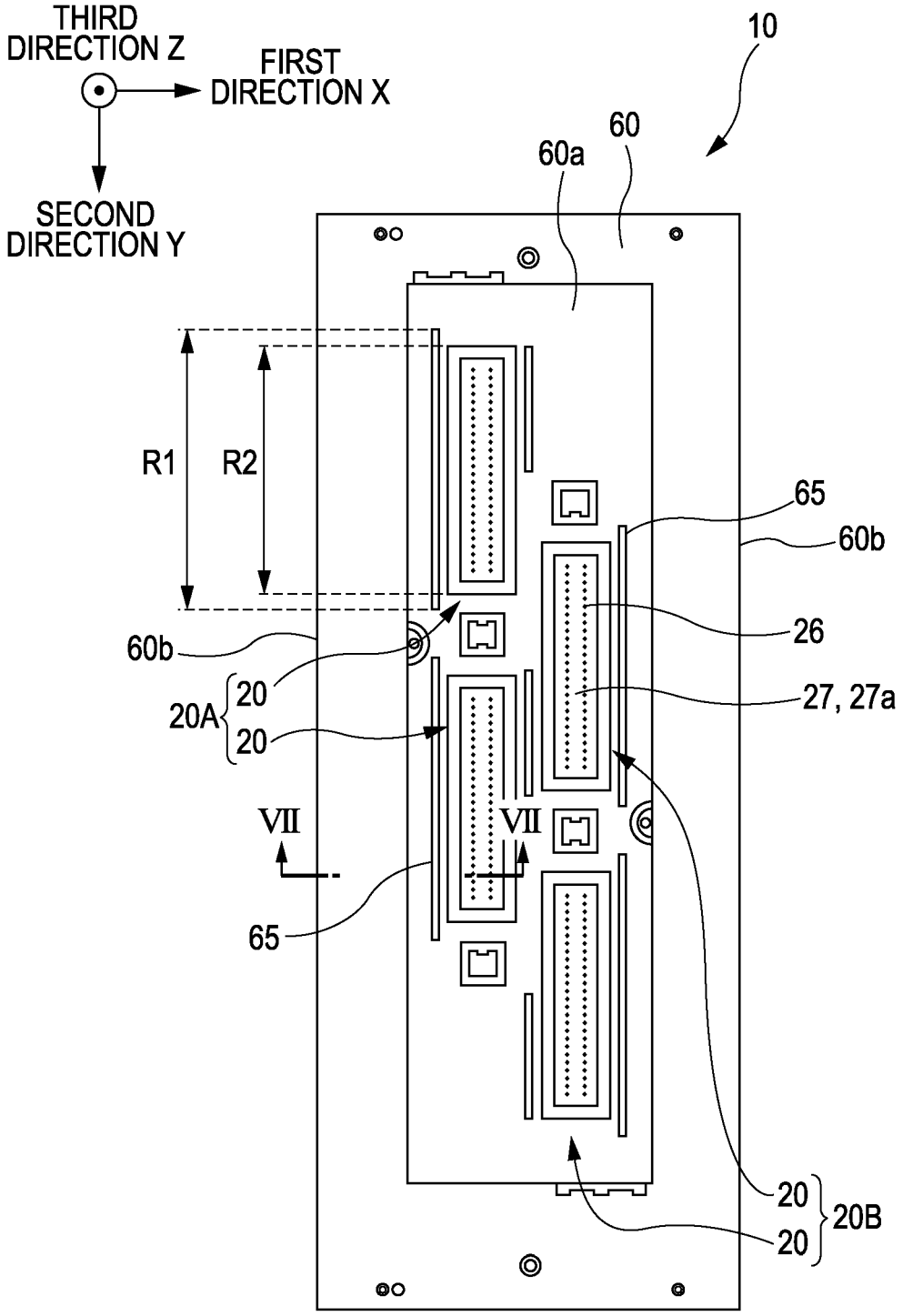
FIG. 6 is a plan view of the nozzle opening side of the recording head related to Embodiment 1.
Figure 7:
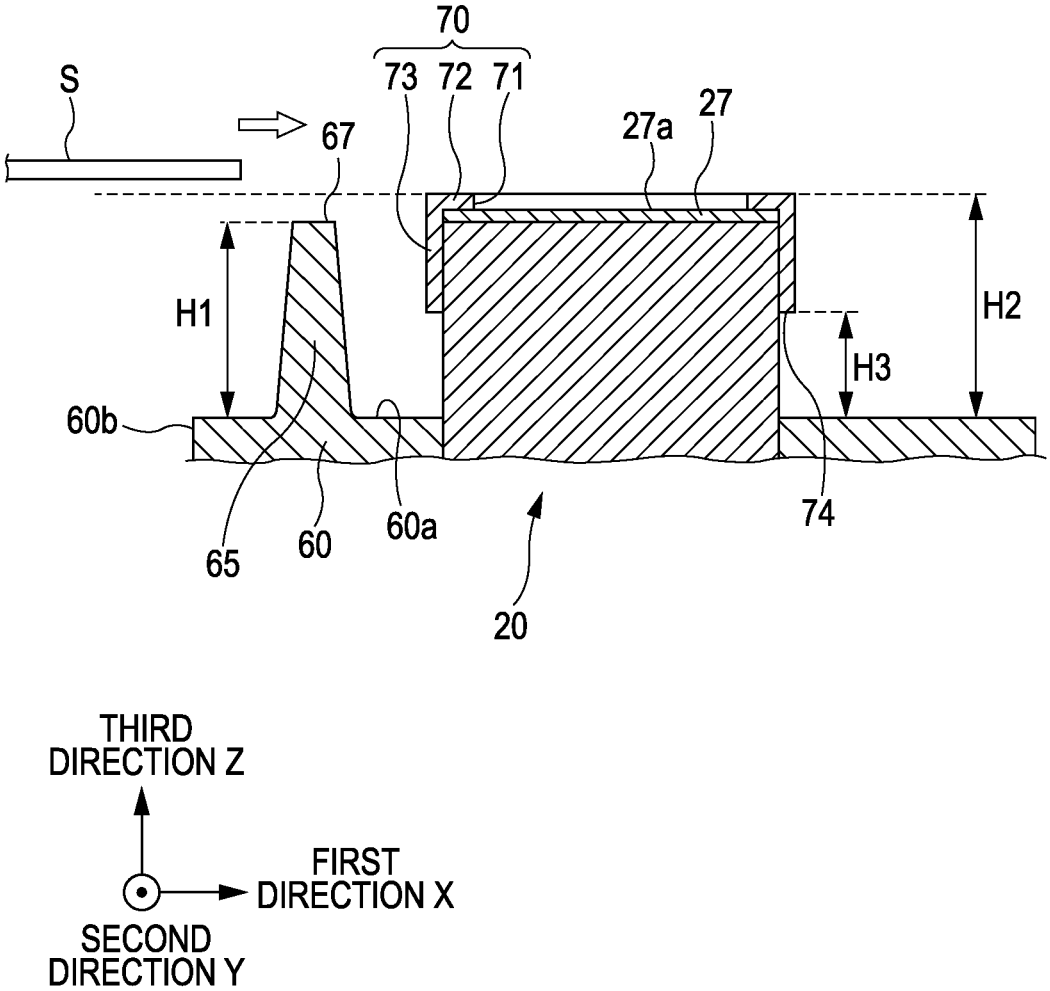
FIG. 7 is a cross-sectional view of a main portion taken along line VII-VII of FIG. 6.

Here, each protective wall 65 provided at the case member 60 will be described in detail. FIG. 6 is a plan view of the nozzle opening side of the recording head related to this embodiment, and FIG. 7 is a cross-sectional view of a main section taken along line VII-VII of FIG. 6.

A first direction X shown in FIG. 6 is a direction in which the recording head 10 relatively moves with respect to a recording sheet. A second direction Y is a direction perpendicular to the first direction X and the nozzle openings 26 of the recording head 10 are arranged side by side in the second direction Y. A third direction Z is a direction perpendicular to the first direction X and the second direction Y and ink is discharged in the third direction Z from the nozzle opening 26.

As shown in FIG. 6, at the case member 60, the protective wall 65 that is one example of a protective member is provided for each head main body 20. The protective wall 65 protrudes in the third direction Z from the bottom surface 60*a* of the case member 60. Further, each protective wall 65 is long in the second direction Y and is longer than the length in the second direction Y of each head main body 20.

The protective wall 65 is disposed between an end portion 60*b* in the first direction X of the case member 60 and the head main body 20. In this embodiment, the protective walls 65 are disposed between a head row 20A and the end portion 60*b* close to the head row 20A. Similarly, the protective walls 65 are disposed between a head row 20B and the end portion 60*b* close to the head row 20B. The head row, as referred to herein, means a plurality of (two) recording heads 10 arranged side by side in the second direction Y.

The distance in the first direction X between the protective wall 65 and the head main body 20 is not particularly limited. However, it is preferable that the protective wall 65 be close to the head main body 20.

Further, in the protective wall 65 disposed for each head main body 20, a range R2 in the second direction Y of the cover head 70 is included in a range R1 in the second direction Y of the protective wall 65. The range in the second direction Y of the protective wall 65, as referred to herein, means the position and the length in the second direction Y of the protective wall 65. The same is true on the range in the second direction Y of the cover head 70. That the range R2 is included in the range R1 means that both end portions of the range R2 are located more inside than both end portions of the range R1.

As shown in FIG. 7, a top 67 of the protective wall 65 is located further on the case member 60 side than the liquid ejecting surface 27*a* (the surface of the frame portion 72 of the cover head 70). That is, a height H1 in the third direction Z from the case member 60 to the top 67 of the protective wall 65 is lower than a height H2 in the third direction Z from the case member 60 to the liquid ejecting surface 27*a*.

Further, the top 67 of the protective wall 65 is located further on the liquid ejecting surface 27*a* side than a lower end portion 74 of the side wall portion 73 of the cover head 70. That is, the height H1 of the protective wall 65 is higher than a height H3 from the case member 60 to the lower end portion 74.

The top 67 of the protective wall 65, as referred to herein, is a site on the most liquid ejecting surface 27*a* side of the protective wall 65, and the lower end portion 74 of the side wall portion 73 of the cover head 70 is a site on the most case member 60 side of the side wall portion 73.

As described above, each protective wall 65 is located between each end portion 60*b* of the case member 60 and each head main body 20 and disposed at the case member 60 in such a manner that the range R1 in the second direction of the cover head 70 is included in the range R1 in the second direction Y. That is, the protective wall 65 is interposed between a recording sheet S which relatively moves with respect to the recording head 10 along the first direction X and the cover head 70, thereby allowing the entire side surface in the second direction Y of the cover head 70 to be protected from the recording sheet S.

By configuring the protective wall 65 in this manner, even if the recording sheet S is bent to the head main body 20 side, since the recording sheet S collides with the protective wall 65, a collision of the recording sheet S with the side surface of the cover head 70 parallel to the second direction Y is prevented. In addition, in order to more ensure the protection of the cover head 70 by the protective wall 65, it is preferable that the top 67 of the protective wall 65 be on the liquid ejecting surface 27*a* side as much as possible.

Further, the top 67 of the protective wall 65 is located further on the case member 60 side than the liquid ejecting surface 27*a*. In this way, when the recording sheet S is transported without being bent, the transportation of the recording sheet S is not impeded by the protective wall 65.

Further, the top 67 of the protective wall 65 is located further on the liquid ejecting surface 27*a* side than the lower end portion 74 of the side wall portion 73 of the cover head 70. Therefore, even if the recording sheet S is bent to the head main body 20 side and then reaches the head main body 20 beyond the protective wall 65, it is difficult for the recording sheet S to reach the lower end portion 74 of the side wall portion 73. In this manner, since the recording sheet S does not reach the lower end portion 74 of the side wall portion 73, the recording sheet S is prevented from entering into the clearance between the side surface of the head main body 20 and the side wall portion 73 from the lower end portion 74 side. As a result, dropout of the cover head 70 from the head main body 20 due to entry of the recording sheet S into the clearance is prevented.

As described above, in the recording head 10 related to this embodiment, since the protective wall 65 is provided for each head main body 20, it is possible to prevent occurrence of a paper jam due to contact of the recording sheet S with the cover head 70.

Further, since the protective wall 65 is formed to be long in the second direction Y, the stiffness of the case member 60 is improved, so that flexure in the second direction Y of the case member 60 is prevented. As a result, flexure of the circuit substrate 90 with the flexure of the case member 60 and detachment of the drive wiring 35 from the circuit substrate 90 are prevented.

Here, a description will be performed with respect to a method of manufacturing the recording head 10, particularly, a method of attaching the drive wiring 35 to the circuit substrate 90. In addition, FIGS. 8A and 8B are cross-sectional views showing the method of manufacturing the recording head.

Figure 8A:
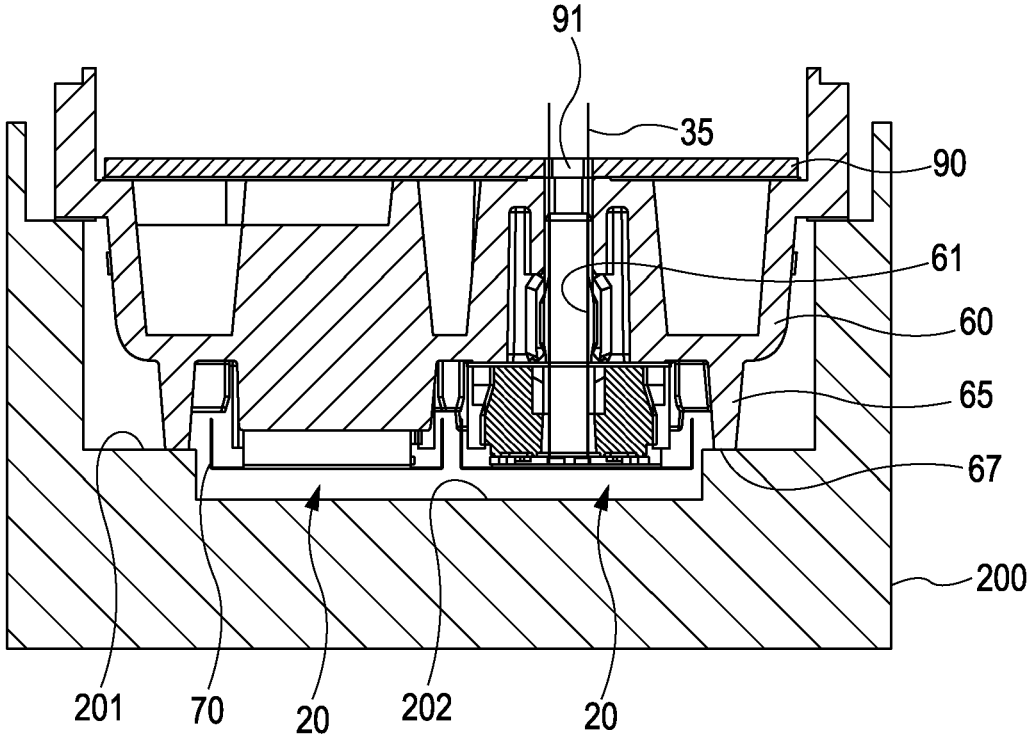
FIGS. 8A and 8B are cross-sectional views showing a method of manufacturing the recording head related to Embodiment 1.
Figure 8B:
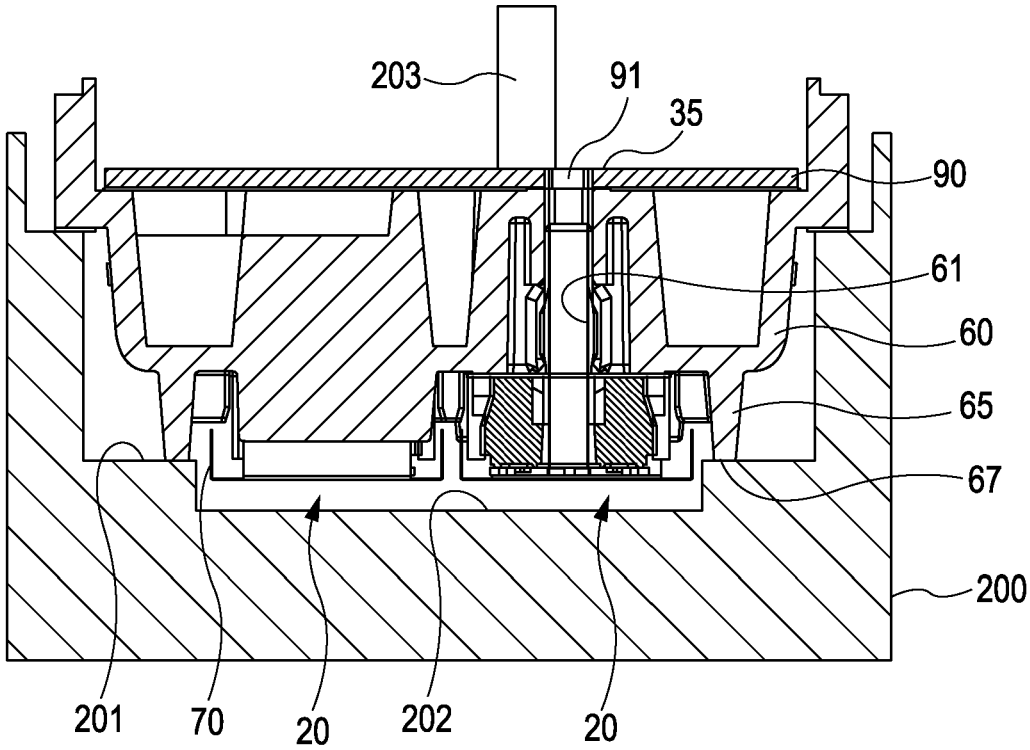

As shown in FIG. 8A, the head main bodies 20 are attached to the case member 60. In each head main body 20, one end of the drive wiring 35 is connected to the lead electrode 34 (refer to FIG. 5). The other end of the drive wiring 35 is inserted into and passes through the through-hole 61 of the case member 60 and the connection hole 91 of the circuit substrate 90.

A jig 200 is a box-shaped member which retains the case member 60 and has an opened upper portion. In a bottom surface 201 of the jig 200, a concave portion 202 in which the head main bodies 20 are accommodated is provided.

The case member 60 in which the head main bodies 20 are held is retained in the jug 200. Specifically, the tops 67 of the protective walls 65 are brought into contact with the bottom surface 201 of the jig 200. Since at the case member 60, the protective wall 65 is provided for each head main body 20, the respective protective walls 65 disposed in the vicinity of the respective head main bodies 20 support the whole of the case member 60. In addition, the head main bodies 20 are accommodated in the concave portion 202 and do not come into contact with the jig 200. For this reason, the load of the recording head 10 is not applied to the head main bodies 20.

Next, as shown in FIG. 8B, the other end of the drive wiring 35 is bent to and pressed against the surface side of the circuit substrate 90 by a joining tool 203, thereby bringing the surface on one side of the other end side into contact with the surface of the circuit substrate 90. The joining tool 203 can solder the drive wiring 35 to a given terminal or the like of the circuit substrate. A load is applied to the circuit substrate 90 and the case member 60 due to the pressing by the joining tool 203.

Here, as shown in FIG. 6, since the plurality of head main bodies 20 are arranged side by side in the second direction Y, the case member 60 is long in the second direction Y. Therefore, the central portions of the circuit substrate 90 and the case member 60 tries to be bent to the bottom surface 201 side of the jig 200 due to a load by the joining tool 203.

However, as described above, since the protective wall 65 is provided for each head main body 20 and the respective protective walls 65 support the whole of the case member 60, even if a load by the joining tool 203 is applied, flexure of the circuit substrate 90 and the case member 60 is prevented.

That is, even if a load is applied to the circuit substrate 90 and the case member 60 by the joining tool 203 in order to electrically connect the drive wiring 35 to the circuit substrate 90, flexure of the circuit substrate 90 and the case member 60 can be prevented. In this manner, since the circuit substrate 90 is not bent, it is possible to reliably bring the surface on one side of the other end side of the drive wiring 35 into contact with the surface of the circuit substrate 90 without a clearance. As a result, poor joining of the drive wiring 35 and the circuit substrate 90 is prevented, so that the yield of the recording head 10 can be improved.

In addition, the invention is not limited to a case where a load is applied to the circuit substrate 90 and the case member 60 by the joining tool 203 for the above-described soldering. The method of manufacturing the recording head related to this embodiment can be applied to the case of pressing the drive wiring 35 in order to join it to the circuit substrate 90.

Thereafter, although it is not particularly shown in the drawings, by sequentially mounting the seal members 95, the flow path member 80, the filters 110, the ink supply needles 100 on the circuit substrate 90, accommodating these members in the cover member 82, and fixing them to the case member 60, the recording head 10 is manufactured.

Embodiment 2

Figure 9:
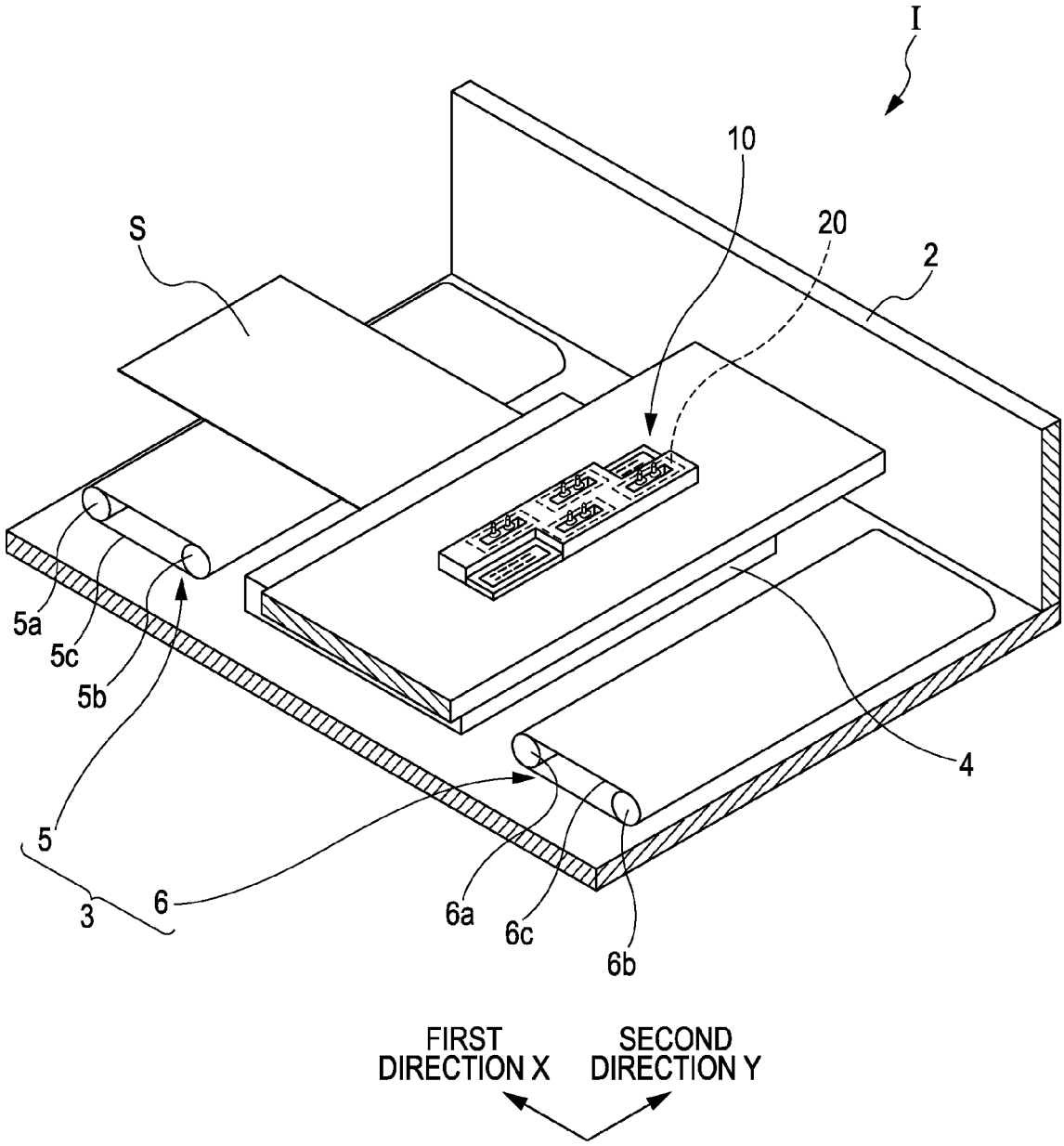
FIG. 9 is a schematic perspective view of an ink jet type recording apparatus related to Embodiment 2.

The recording head 10 described in Embodiment 1 is mounted on an ink jet type recording apparatus that is one example of the liquid ejecting apparatus. FIG. 9 is a schematic perspective view showing an ink jet type recording apparatus that is one example of a liquid ejecting apparatus related to Embodiment 2 of the invention. In addition, the same component as that in Embodiment 1 is denoted by the same reference numeral and repeated explanation is omitted.

As shown in FIG. 9, an ink jet type recording apparatus I related to this embodiment is a so-called line type recording apparatus in which the recording head 10 is fixed and the recording sheet S such as paper that is a recording medium is transported, whereby printing is performed. The first direction X is a direction of relative movement of the recording head 10 with respect to the recording sheet S, and the second direction Y is a direction perpendicular to the first direction X.

Specifically, the ink jet type recording apparatus I is provided with an apparatus main body 2, the recording head 10 fixed to the apparatus main body 2, a transport section 3 which transports the recording sheet S that is the recording medium, and a platen 4 which supports the back surface side that is the opposite side to the printing surface of the recording sheet S, which faces the recording head 10.

The recording head 10 is fixed to the apparatus main body 2 in such a manner that the arrangement direction of the nozzle openings 26 of the head main body 20 becomes the second direction Y intersecting the transport direction (the first direction X) of the recording sheet S.

The transport section 3 includes a first transport section 5 and a second transport section 6 which are provided on both sides in the transport direction of the recording sheet S with respect to the recording head 10.

The first transport section 5 is constituted by a driving roller 5*a*, a driven roller 5*b*, and a transport belt 5*c* wound around the driving roller 5*a* and the driven roller 5*b*. Further, the second transport section 6 is constituted by a driving roller 6*a*, a driven roller 6*b*, and a transport belt 6*c*, similarly to the first transport section 5.

A driving section (not shown) such as a driving motor is connected to each of the driving rollers 5*a* and 6*a* of the first transport section 5 and the second transport section 6, and the transport belts 5*c* and 6*c* are rotationally driven by a driving force of the driving section, whereby the recording sheet S is transported from the upstream side to the downstream side of the recording head 10.

In addition, in this embodiment, The first and second transport sections 5 and 6 which are respectively constituted by the driving rollers 5*a* and 6*a*, the driven rollers 5*b* and 6*b*, and the transport belts 5*c* and 6*c* have been exemplified. However, a retention section which retains the recording sheet S on the transport belts 5*c* and 6*c* may also further provided. As the retention section, for example, a configuration is also acceptable in which an electrification section which electrifies the outer circumferential surface of the recording sheet S is provided and the recording sheet S electrified by the electrification section is drawn and stuck onto the transport belts 5*c* and 6*c* by the action of dielectric polarization. Further, as the retention section, a configuration is also acceptable in which presser rollers are provided above the transport belts 5*c* and 6*c* and the recording sheet S is gripped between the presser rollers and the transport belts 5*c* and 6*c*.

The platen 4 is a member made of metal, resin, or the like, having a rectangular cross-section, and provided to face the recording head 10 between the first transport section 5 and the second transport section 6. The platen 4 supports the recording sheet S transported by the first transport section 5 and the second transport section 6, at a position which faces the recording head 10.

In addition, a suction and sticking section which suctions and sticks the transported recording sheet S to the platen 4 may also be provided at the platen 4. As the suction and sticking section, for example, a configuration in which the recording sheet S is suctioned and stuck, a configuration in which the recording sheet S is electrostatically drawn and stuck by an electrostatic force, or the like can be given.

Further, although it is not shown in the drawing, an ink storage section such as an ink tank or an ink cartridge in which ink is stored is connected to the recording head 10 so as to be able to supply ink. The ink storage section may also be held above the recording head 10, for example. Further, the ink storage section may also be held at a position different from that of the recording head 10 in the apparatus main body 2 and connected to each ink supply needle 100 of the recording head 10 through a tube or the like. Further, an external wiring (not shown) is connected to the recording head 10.

In the ink jet type recording apparatus I, the recording sheet S is transported by the first transport section 5, and printing is carried out on the recording sheet S supported on the platen 4 by the recording head 10. The printed recording sheet S is transported by the transport section 3.

Other Embodiments

Each embodiment of the invention has been described above. However, the basic configuration of the invention is not limited to those described above.

In Embodiment 1, the protective wall 65 is parallel to the second direction Y. However, it is not limited thereto. Further, the nozzle openings 26 are arranged side by side in the second direction Y and the side surfaces of the head main body 20 are disposed to be parallel to the second direction Y. However, the configurations are not limited thereto.

Figure 10A:
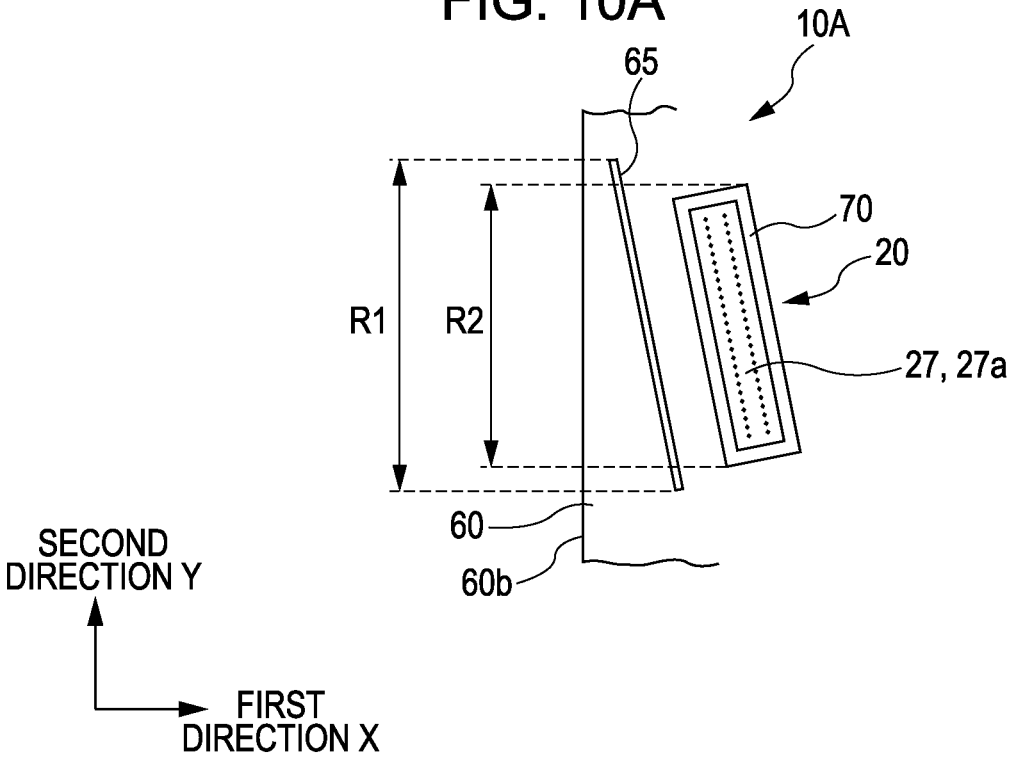
FIGS. 10A and 10B respectively are a plan view and a cross-sectional view of recording heads related to modified examples.

For example, as shown in FIG. 10A, the protective wall 65 is located between the end portion 60*b* and the head main body 20 and the range R1 in the second direction Y of the cover head 70 is included in the range R2 in the second direction Y of the protective wall 65. In such a configuration, the protective wall 65 may also intersect the second direction Y, and also in the head main body 20, the arrangement direction of the nozzle openings 26 may also intersect the second direction Y. Also in such a recording head 10A, the same operation and effects as those of the recording head 10 related to Embodiment 1 are obtained.

Further, the protective wall 65 need not be formed to be long and the head main body 20 also need not be long according to the arrangement direction of the nozzle openings 26. That is, it is acceptable if it is a shape or a configuration in which the protective wall 65 is located between the end portion 60*b* and the head main body 20 and the range R1 in the second direction Y of the cover head 70 is included in the range R2 in the second direction Y of the protective wall 65.

Further, in Embodiment 1, the height of the protective wall 65 is lower than the height H2 of the liquid ejecting surface 27*a* of the head main body 20. However, it is not limited thereto.

Figure 10B:
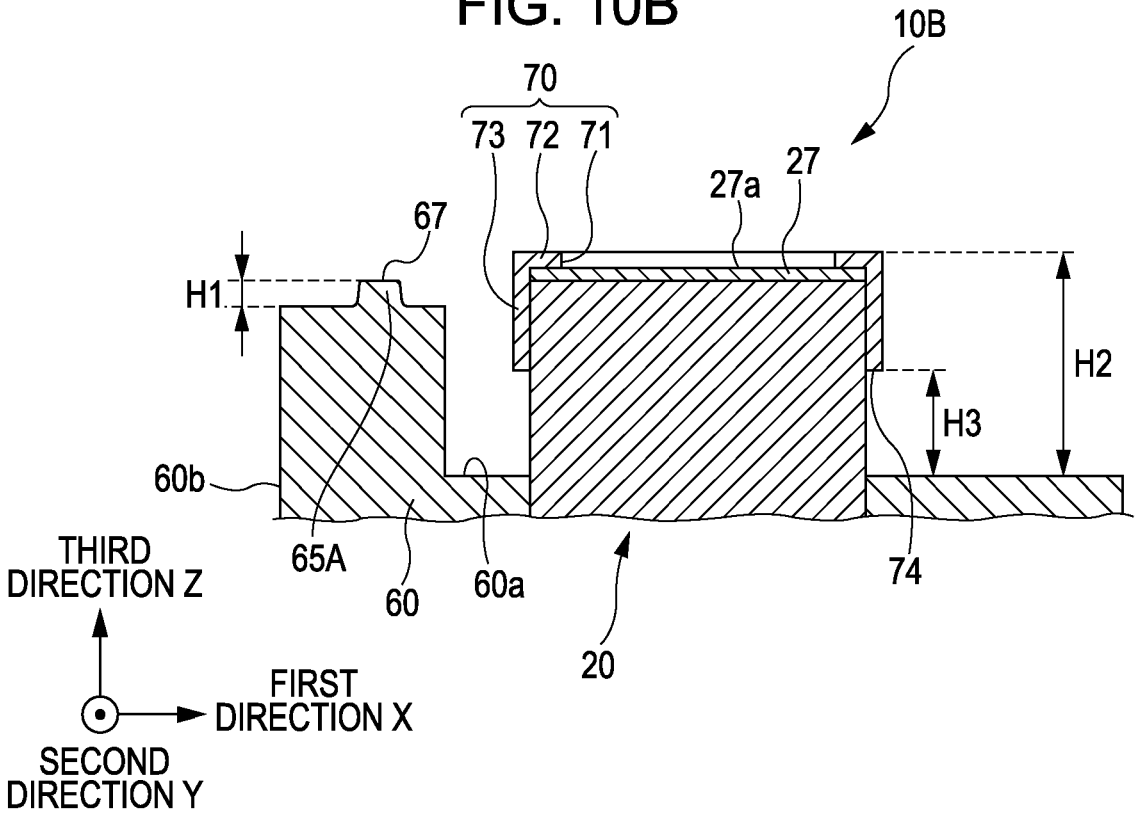

For example, as shown in FIG. 10B, in a case where the bottom surface 60*a* of the case member 60 is not flat, but is stepped, it can be said that the height H1 of a protective wall 65A is lower than the height H2 of the liquid ejecting surface 27*a*. However, if the top 67 of the protective wall 65A is located further on the case member 60 side than the liquid ejecting surface 27*a*, a recording head 10B exhibits the same operation and effects as those of the recording head 10 related to Embodiment 1.

Figure 11:
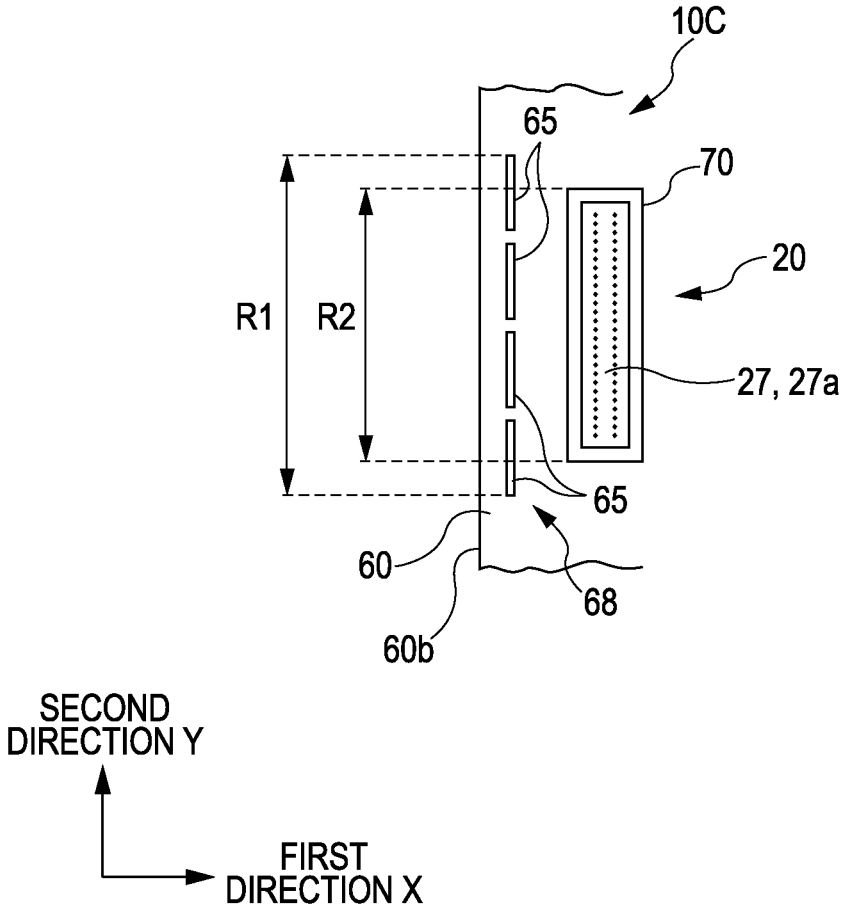
FIG. 11 is a plan view of a recording head related to still another modified example.

Further, as shown in FIG. 11, a plurality of protective walls 65 may also be provided for a single head main body. In this case, the distance between the respective protective walls 65 in the second direction Y is set to be equal to or less than the width in the second direction Y of the recording sheet S. In such a case, it is acceptable if the range R2 in the second direction Y of the cover head 70 is included in the range R1 in the second direction Y of a protective wall group 68 composed of the plurality of protective walls 65. Such a recording head 10C exhibits the same operation and effects as those of the recording head 10 related to Embodiment 1.

Further, although it is not particularly shown in the drawings, a single protective wall may also be provided for a plurality of head main bodies. In this case, it is acceptable if a single protective wall is disposed between the end portion 60*b* of the case member 60 and each head main body 20 and the range R2 in the second direction of each head main body 20 is included in the range R1 in the second direction Y of the protective wall.

Further, the protective wall may also be disposed so as to surround the head main body 20. That is, it is acceptable if at least a portion of the protective wall is provided between the end portion 60*b* of the case member 60 and the head main body 20 and the range R2 of the cover head 70 is included in the above-mentioned range R1 of the protective wall.

In the recording head 10 related to Embodiment 1, four head main bodies 20 are provided. However, of course, there is no limitation to the number of pieces. Further, the case member 60 is long in the second direction. However, the shape thereof is not limited thereto.

Further, in Embodiment 1, a description has been performed using the thin-film type piezoelectric element 30 as the pressure generation section which causes a pressure change in the pressure generation chamber 22. However, it is not particularly limited thereto. For example, a thick-film type piezoelectric actuator which is formed by a method such as attaching a green sheet, a longitudinal vibration type piezoelectric actuator in which a piezoelectric material and an electrode forming material are alternately laminated and expansion and contraction is performed in an axial direction, or the like can be used. Further, as the pressure generation section, a configuration in which a heater element is disposed in a pressure generation chamber and a liquid droplet is discharged from a nozzle opening by a bubble which is generated by heat generation of the heater element, a so-called electrostatic actuator in which static electricity is generated between a vibration plate and an electrode and the vibration plate is deformed by an electrostatic force, thereby discharging a liquid droplet from a nozzle opening, or the like can be used.

In addition, in the embodiments described above, as one example of the liquid ejecting head, the ink jet type recording head has been given and described. However, the invention broadly targets liquid ejecting heads and, of course, it is also possible to apply the invention to a liquid ejecting head which ejects liquid other than ink. As other liquid ejecting heads, for example, various recording heads which are used in image recording apparatuses such as a printer, a color material ejecting head which is used for the manufacturing of a color filter of a liquid crystal display or the like, an electrode material ejecting head which is used for the formation of an electrode of an organic EL display, an FED (a field emission display), or the like, a biological organic matter ejecting head which is used for the manufacturing of a biochip, and the like can be given.

The entire disclosure of Japanese Patent Application No. 2011-049540, filed Mar. 7, 2011 is incorporated by reference herein.

What is claimed is:

1. A liquid ejecting head comprising head main bodies each having a liquid ejecting surface in which nozzle openings that eject liquid are provided, and a case member to which the head main bodies are fixed, and relatively moving in a first direction with respect to a recording medium onto which a liquid droplet is ejected, wherein a covering member which covers a peripheral border of the liquid ejecting surface and side surfaces continued from the liquid ejecting surface is provided at each head main body, at the case member, a protective member which protects the covering member is provided for each head main body between an end portion in the first direction of the case member and the head main body, a range in a second direction perpendicular to the first direction of the covering member is included in a range in the second direction of the protective member, and the protective member is located further on the case member side than the liquid ejecting surface in a third direction perpendicular to the first direction and the second direction.

2. The liquid ejecting head according to claim 1, wherein the protective member is located further on the liquid ejecting surface side than an end portion on the case member side of the covering member which covers the side surfaces of the head main body.

3. The liquid ejecting head according to claim 1, wherein in the protective member, the length in the second direction is longer than the length in the first direction.

4. A liquid ejecting apparatus comprising: the liquid ejecting head according to claim 1.

5. A liquid ejecting apparatus comprising: the liquid ejecting head according to claim 2.

6. A liquid ejecting apparatus comprising: the liquid ejecting head according to claim 3.

7. A method of manufacturing a liquid ejecting head which includes:

head main bodies each having a liquid ejecting surface in which nozzle openings that eject liquid are provided;

a case member to which the head main bodies are fixed, and relatively moving in a first direction with respect to a recording medium onto which a liquid droplet is ejected;

wherein a covering member which covers a peripheral border of the liquid ejecting surface and side surfaces continued from the liquid ejecting surface is provided at each head main body;

at the case member, a protective member which protects the covering member is provided for each head main body between an end portion in a first direction of the case member and the head main body;

a range in a second direction perpendicular to the first direction of the covering member is included in a range in the second direction of the protective member;

the protective member is located further on the case member side than the liquid ejecting surface in a third direction perpendicular to the first direction and the second direction; and a circuit substrate which is provided in the case member and to which a pressure generation element constituting the head main body is connected through a drive wiring, and moves relatively in the first direction with respect to a recording medium onto which a liquid droplet is ejected, the method comprising:

bringing the protective members into contact; and connecting the other end of the drive wiring, one end of which is connected to the pressure generation element of the head main body, to the circuit substrate.

* * * * *